US005711609A

United States Patent [19]

Simonsen

[11] Patent Number: 5,711,609

[45] Date of Patent: Jan. 27, 1998

[54] CHILD RESISTANT PACKAAGE

[75] Inventor: Steven H. Simonsen, Neenah, Wis.

[73] Assignee: Reynolds Consumer Product, Inc., Appleton, Wis.

[21] Appl. No.: 821,606

[22] Filed: Mar. 20, 1997

Related U.S. Application Data

[63] Continuation of Ser. No. 565,132, Jan. 11, 1996, abandoned.

[51] Int. Cl.[6] ..... B65D 33/16

[52] U.S. Cl. ..... 383/63; 383/5

[58] Field of Search ..... 383/5, 35, 61, 383/63, 65

[56] References Cited

U.S. PATENT DOCUMENTS

| | | | |
|---|---|---|---|
| 3,808,649 | 5/1974 | Ausnit | 383/63 X |
| 4,268,938 | 5/1981 | Walchli . | |
| 4,617,683 | 10/1986 | Christoff | 383/65 X |
| 4,736,451 | 4/1988 | Ausnit | 383/65 |
| 4,744,674 | 5/1988 | Nocek . | |
| 4,791,710 | 12/1988 | Nocek et al. | 383/65 X |
| 5,272,794 | 12/1993 | Hamatani et al. . | |
| 5,351,369 | 10/1994 | Swain . | |
| 5,372,428 | 12/1994 | Bruno et al. | 383/63 X |
| 5,425,825 | 6/1995 | Rasko et al. | 383/61 X |

FOREIGN PATENT DOCUMENTS 1140723 8/1957 France .

*Primary Examiner*—Jes F. Pascua
*Attorney, Agent, or Firm*—Alan T. McDonald

[57] ABSTRACT

A flexible reclosable package comprises first and second opposing films and first and second closure profiles attached to inner surfaces of the respective first and second films. The first closure profile includes a first closure element and a first lower lateral flange extending downward from the first closure element. The second closure profile includes a second closure element and a second lower lateral flange extending downward from the second closure element. The first and second closure elements are releasably engaged with each other. To render the package child resistant, the first and second closure profiles are free of respective graspable upper flanges extending upward from the respective first and second closure elements. The first and second closure profiles are free of mechanical means operably coupled thereto such that the first and second closure profiles are disengaged by grasping the first and second films below the first and second closure elements and pulling the first and second films in opposite directions.

6 Claims, 1 Drawing Sheet

CHILD RESISTANT PACKAAGE

This application is a continuation of application Ser. No. 08/565132 filed Jan. 11, 1996, now abandoned.

FIELD OF THE INVENTION

The present invention generally relates to reclosable packages which are child resistant. In particular, the present invention relates to the placement of package opening features such that unauthorized opening by children of the package is prevented.

BACKGROUND OF THE INVENTION

Storage containers for pills and similar products exist in many forms. These containers usually require a complex series of operations for the user to open them. Although these containers have mechanisms which are more than adequate in preventing children from opening them, many adults find the containers difficult, if not impossible, to open. For instance, some storage containers require a person to first align the lid of the container with a mark on the container body. Then, the person must turn the lid of the container while simultaneously providing a downward force on the container. The instructions for opening such containers are often missing, or, if given, difficult to read and understand. Therefore, a need exists for a storage container that is child resistant yet easy for adults to open.

The storage containers described above are often relatively costly to produce. The creation of a bottle, for instance, requires a costly series of manufacturing steps. Additionally, the bottle manufacturing process requires the production of bottle caps. Film packages, on the other hand, are relatively simple to make and require fewer steps in the manufacturing process. Often, the film package can be produced in only one step. Thus, a further need exists for a device that, in addition to the above mentioned needs, is economical to produce.

Storage containers are also often bulky to store. Medicine cabinets are often small and full of other products. The containers, being of significant size, often do not fit into such spaces. Bulky containers also create problems for travelers who desire to fit their medications into as small a space as is possible. Additionally, a person carrying a container in their pocket may not desire the bulky appearance of the bottle in their pocket. It would be desirable have a container which would conveniently fit into the shape of the pocket. Thus, in addition to the above needs, a need exists for a storage device that is not bulky to store and can be placed in small, confined spaces.

Containers also often have significant weight, that in certain situations is not desirable. For example, many people desire to carry the least amount of weight with them in their pockets. For example, the elderly, who may need to carry many different kinds of prescription drugs with them, may find it difficult to carry these prescriptions in containers due to the combined weight of these containers. Furthermore, the reduction of weight makes shipping of containers both easier and more economical for manufacturers of pharmaceutical products. Therefore, in addition to the needs discussed above, a storage container of minimal weight is needed.

Many of the containers mentioned above can also break when dropped. Obviously, a flexible polymeric bag will not break when dropped. Therefore, in addition to the needs listed above, a need exists for a storage container that will not break or be damaged when dropped.

SUMMARY OF THE INVENTION

In one particular embodiment, the present invention provides a flexible reclosable package comprising first and second opposing films and first and second closure profiles attached to inner surfaces of the respective first and second films. The first closure profile includes a first closure element and a first lower lateral flange extending downward from the first closure element. The second closure profile includes a second closure element and a second lower lateral flange extending downward from the second closure element. The first and second closure elements are releasably engaged with each other. To render the package child resistant, the first and second closure profiles are free of respective graspable upper flanges extending upward from the respective first and second closure elements. The first and second closure profiles are free of mechanical means operably coupled thereto such that the first and second closure profiles are disengaged by grasping the first and second films below the first and second closure elements and pulling the first and second films in opposite directions.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
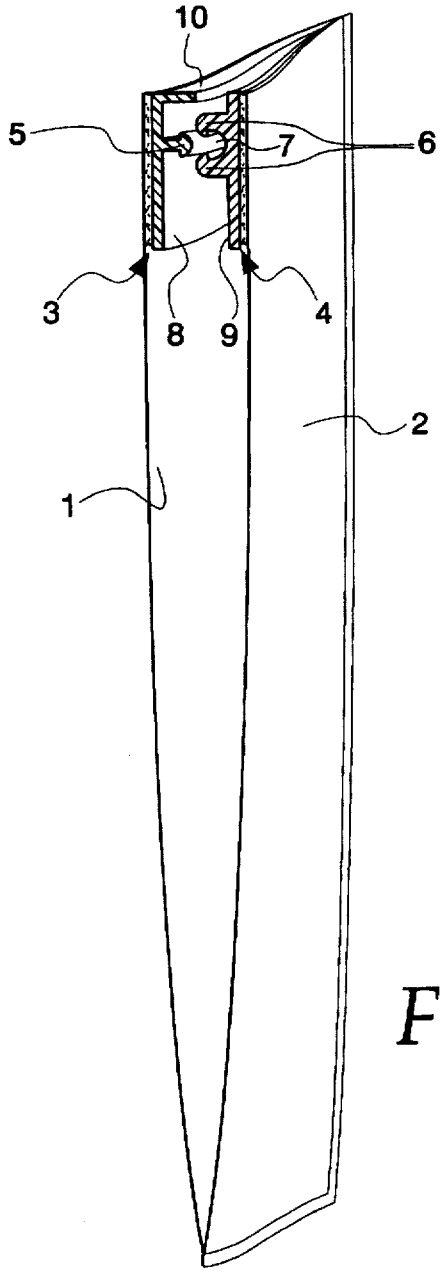
FIG. 1 is a perspective view of a flexible reclosable package embodying the present invention, with portions broken away to reveal the internal structure of the package.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

One embodiment of the present invention is illustrated in FIG. 1. As shown, first and second opposing films 1 and 2 are brought together to form a reclosable polymeric package. As shown in FIG. 1, a male closure profile 3 and a female closure profile 4 are attached at the inner surfaces of opposing films 1 and 2. The male closure profile 3 in this embodiment has a protruding male member 5 while the female closure profile 4 includes a pair of locking members 6 forming a groove 7 for receiving the male member 5. When pressure is applied to the male and female closure profiles 3 and 4, they engage and form a reclosable sealable: mechanism. Generally, the male and female closure profiles 3 and 4 are manufactured. separately from the package and are subsequently attached to the package. First and second lower lateral flanges 8 and 9 are shown below the male locking member 5 and the pair of locking members 6, respectively. As shown in FIG. 1, there are no graspable upper flanges above the locking members. Thus, a child would have great difficulty opening the package, thereby making it child resistant. A person desiring to obtain the contents of the package of FIG. 1 would grasp the first film 1 with one hand and the second film 2 with the other hand below the male and female closure profiles 3 and 4 in a position which provides maximum leverage for opening the package. By applying an outwardly directed force, the person would detach the male closure profile 3 from the female closure profile 4 to open the package. The force required to disengage the male and female closure profiles 3 and 4 is preferably in the range of approximately 0.75 pounds per square inch to 8 pounds per square inch. The closure profile 3 may include an inwardly directed post 10 to facilitate disengagement of the closure profiles 3 and 4. The post 10 also serves to facilitate alignment of the male member 5 with the groove 7 during reclosure and to make it difficult to grasp any portion of the closure profiles 3 and 4 above their respective locking members.

Figure 2:
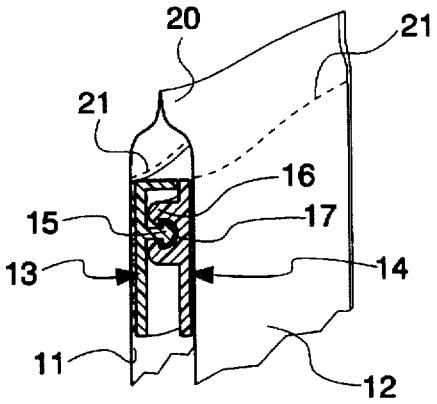
FIG. 2 is a perspective view of an upper portion of a modified flexible reclosable package having a removable header, with portions broken away to reveal the internal structure of the package.

Another embodiment of the present invention is illustrated in FIG. 2. As shown, first film 11 and second film 12 are brought together to form a reclosable package that is tamper and child resistant. As shown in FIG. 2, male closure profile 13 and female closure profile 14 are attached at the inner surfaces of the films 11 and 12. The male closure profile 13 in this embodiment has protruding male member 15 while the female closure profile 14 includes locking members 17 forming groove 18 for receiving the male member 15. When pressure is applied to the male and female closure profiles 13 and 14, they engage and form a reclosable sealable mechanism. First and second lower lateral flanges 18 and 19 are shown as being below the closure profiles. However, in this embodiment, a removable header 20 is connected to films 11 and 12 along perforated lines 21 above the male and female closure profiles 13 and 14. The perforated lines 21 may be substituted with die lines, thinned area lines, or other weakening means. The header 20 is detachable such that when removed, the area above the closure profiles 13 and 14 is substantially free of a graspable upper flange. Thus, any tampering will be apparent to a user. Furthermore, since there is still not a graspable surface above the closure profiles, the package remains child resistant. A user, when desiring to open the package of FIG. 2 would first remove the header 20. Then, as with the embodiment shown in FIG. 1, the user would grasp the first film 11 with one hand below the male closure profile 13 and the second film 12 with the other hand below the female closure profile 14. By applying an outwardly directed force, the user would detach the male closure profile 13 from the female closure profile 14.

In the packages depicted in FIGS. 1 and 2, the closure profiles are generally composed of a polymer such as polyethylene, polypropylene, or a blend of polyethylene and ethylene vinyl acetate (EVA). The use of a low-cost material, such as low density polyethylene (LDPE), for making the closure profiles results in a significant savings in materials cost compared to profiles made of a substantially pure ionomer resin, such as SURLYN® (trademark of EI DuPont de Nemours & Co. of Wilmington, Del.). Although the actual volume of the ionomer resin needed for a single profile strip appears small, a facility mass producing large mounts of resealable sealing devices would utilize large mounts of ionomer resin. Thus, even a minor cost savings in such a material can result in a significant reduction in cost of material.

The package films, including the header 20 in FIG. 2, may be composed of a single layer of low density polyethylene or, alternatively, may be composed of two or more layers of material. If the films are composed of multiple layers, the inner layer may be composed of a sealant material such as low density polyethylene or low density polyethylene blended with ethylene vinyl acetate. The outer layer may be composed of one or more barrier materials characterized by higher toughness, stiffness, and heat resistance as compared to the inner layer. Examples of materials which may be incorporated in the outer layer include polypropylene, polyester, nylon, SURLYN®, and polyethylene terephthalates (PET). Low density polyethylene may be incorporated into the outer layer by applying the low density polyethylene over the surface of one of the foregoing materials.

If the inner layer of the films is composed of a different material than the closure profiles, an intermediary sealant layer may be used to attach the closure profiles to the respective films. The sealant layer may be composed of a material, such as ethylene vinyl acetate, which bonds readily to other polymers at low temperatures and which adheres well to both the films and the closure profiles.

The packages depicted in FIGS. 1 and 2 are manufactured using conventional extrusion and heat sealing techniques. The closure profiles are initially extruded through a die plate forming properly configured channels. The intermediary sealant layer described above may be coextruded with the closure profiles. The extruded closure profiles are then thermally fused, either directly or using the intermediary sealant layer, to the inner surfaces of the respective films to form the reclosable package.

While the present invention has been described with reference to one or more particular embodiments, those skilled in the art will recognize that many changes may be made thereto without departing from the spirit and scope of the present invention. For example, the closure profiles in FIGS. 1 and 2 may be modified to include different engageable profile configurations, so long as the closure profiles are free of graspable upper flanges. Each of these embodiments and obvious variations thereof is contemplated as falling within the spirit and scope of the claimed invention, which is set forth in the following claims.

What is claimed is:

1. A method of opening and reclosing a reclosable package, comprising the steps of:

supplying said package with first and second opposing films, a first closure profile, and a second closure profile, said first and second closure profiles being attached to inner surfaces of said respective first and second films, said first closure profile having a first closure element and a first lower lateral flange extending downward from said first closure element, said second closure profile having a second closure element and a second lower lateral flange extending downward from said second closure element, said first and second closure elements being releasably engaged with each other, said first and second closure profiles being free of respective graspable upper flanges extending upward from said respective first and second closure elements, said first and second profiles being incapable of manual disengagement from above said profiles;

grasping said first and second films below said first and second closure elements;

pulling said first and second films in opposite directions with a force in the range of approximately 0.75 pounds per square inch to 8 pounds per square inch to disengage the first and second closure profiles to thereby open said package without damage to said profiles; and pressing said profiles together with sufficient force to reengage said first and second closure elements and thereby reclose said package.

2. The method of claim 1 wherein said first closure element includes a male member, and said second closure element includes a pair of locking members forming a groove therebetween for receiving said male member.

3. The method of claim 1 wherein said step of grasping said first and second films includes grasping said first and second films approximately in a position which provides maximum leverage for opening the package.

4. The method of claim 1 further including a removable header detachably connected to said films above said first and second closure profiles.

5. The method of claim 4 wherein said removable header is connected to said films along perforated lines.

6. A method of opening and reclosing a reclosable package including first and second opposing films, a first closure profile, and a second closure profile, said first and second closure profiles being attached to inner surfaces of said respective first and second films, said first closure profile having a first closure element and a first lower lateral flange extending downward from said first closure element, said second closure profile having a second closure element and a second lower lateral flange extending downward from said second closure element, said first and second closure elements being releasably engaged with each other, said first and second closure profiles being free of respective graspable upper flanges extending upward from said respective first and second closure elements, said first and second closure profiles being incapable of manual disengagement from above said profiles, said method comprising the steps of:

grasping said first and second films below said first and second closure elements;

pulling said first and second films in opposite directions with a force in the range of approximately 0.75 pounds per square inch to 8 pounds per square inch to disengage said first and second closure profiles to thereby open said package without damage to said profiles; and pressing said profiles together with sufficient force to reengage said first and second closure elements and thereby reclose said package.

* * * * *